United States Patent [19]

Abe et al.

[11] 4,374,682

[45] Feb. 22, 1983

[54] PROCESS FOR PRODUCING DEEP-DRAWING COLD ROLLED STEEL STRIPS BY SHORT-TIME CONTINUOUS ANNEALING

[75] Inventors: Mitsunobu Abe, Tokyo; Ikushi Yoshida, Yokohama; Munetsugu Matsuo, Kawasaki; Hiroshi Hayakawa, Kitakyusyu, all of Japan

[73] Assignee: Nippon Steel Corporation, Tokyo, Japan

[21] Appl. No.: 195,654

[22] Filed: Oct. 9, 1980

Related U.S. Application Data

[63] Continuation-in-part of Ser. No. 117,302, Jan. 31, 1980, abandoned.

[30] Foreign Application Priority Data

Feb. 2, 1979 [JP] Japan ..... 54-10493

[51] Int. Cl.[3] ..... C21D 9/48

[52] U.S. Cl. ..... 148/12 C; 148/12.3; 148/12.4

[58] Field of Search ..... 148/2, 12 C, 12 F, 12 R, 148/12 D, 156, 142, 12.3; 266/111

[56] References Cited

U.S. PATENT DOCUMENTS

| | | | |
|---|---|---|---|
| 3,805,571 | 4/1974 | Toda et al. | 266/111 |
| 3,806,376 | 4/1974 | Toda et al. | 148/12.3 |
| 3,839,095 | 10/1974 | Kubotera et al. | 148/12 C X |
| 3,877,684 | 4/1975 | Kurihara et al. | 148/156 X |
| 3,936,324 | 2/1976 | Uchida et al. | 148/12 F |
| 3,951,696 | 4/1976 | Gondo et al. | 148/12 R |
| 4,016,740 | 4/1977 | Gondo et al. | 148/12 C |
| 4,023,987 | 5/1977 | Nomura et al. | 148/12 D |
| 4,026,729 | 5/1977 | Nakaoka et al. | 148/12.4 |
| 4,040,873 | 8/1977 | Nakaoka et al. | 148/12 C |
| 4,113,517 | 9/1978 | Nakaoka et al. | 148/2 |
| 4,145,235 | 3/1979 | Gondo et al. | 148/142 X |
| 4,285,741 | 8/1981 | Furukawa et al. | 148/12 F X |

*Primary Examiner*—Peter K. Skiff

*Attorney, Agent, or Firm*—Wenderoth, Lind & Ponack

[57] ABSTRACT

A process for producing a cold rolled steel strip having excellent workability by a short-time continuous annealing, which process is constituted by hot rolling a low carbon steel slab of steel having a carbon content of from about 0.003 to 0.08% into a steel strip; cold rolling the hot rolled steel strip; rapidly heating the cold rolled steel strip to a recrystallization temperature range at a heating rate not less than 40° C./second; slowly heating the thus rapidly heated steel strip to an annealing temperature at a heating rate ranging from 5° to 30° C./second; annealing the thus slowly heated steel strip at an annealing temperature T which is no lower than 700° C. and no higher than the $A_3$ transformation temperature and for an annealing time t no shorter than [8−0.03 (T−680)] seconds and no longer than [80−0.15 (T−680)] seconds, initially slowly cooling the thus annealed steel strip at a cooling rate less than 50° C./second, and then rapidly cooling the strip at a cooling rate not less than 50° C./second from a temperature $T_Q$ ranging from higher than 600° C. to no higher than $[T-0.027\,(T-680)(\sqrt{t}+23.7)]$° C. to an over-ageing temperature range; and subjecting the thus cooled steel strip to an over-ageing treatment at a temperature ranging from 300° to 500° C. for a period of time ranging from 10 seconds to 5 minutes.

13 Claims, 6 Drawing Figures

PROCESS FOR PRODUCING DEEP-DRAWING COLD ROLLED STEEL STRIPS BY SHORT-TIME CONTINUOUS ANNEALING

This application is a continuation-in-part of application Ser. No. 117,302 filed Jan. 31, 1980, abandoned.

BACKGROUND OF THE INVENTION

1. Field of the Invention

The present invention relates to a process for producing low carbon content cold rolled steel strips having excellent deep drawing properties by a short-time continuous annealing. By low carbon content steel is meant steel having a carbon content of from 0.003 to 0.08%.

Cold rolled steel strip is widely used for cold forming articles such as press-formed automobile parts, and as such the strip is required to have an excellent press-forming property.

In order to improve the general workability of steel strip, it is necessary to allow full growth of grains in the steel and, on the other hand, to minimize the amount of dissolved or solute carbon in the steel. Further, with respect to the deep-drawability of the steel, it is desirable that the average plastic-strain ratio $\bar{r}$ be large. The $\bar{r}$ value is related to the crystal orientation and the larger the value of the {111} component the larger the $\bar{r}$ value.

Cold rolled steel strip is generally produced by a process which comprises the essential steps of hot rolling and cold rolling the steel to form the strip and annealing the thus rolled strip. For satisfactorily increasing the grain size and the $\bar{r}$ value, it is effective to slowly heat the steel strip and hold it for a long period of time at the annealing temperature, and for reducing the amount of solute carbon, it is effective to subject the steel strip after annealing to slow cooling so as to precipitate substantially all of the carbon content at the grain boundaries.

2. Description of Prior Art

Conventionally, batch annealing has been widely used for production of cold rolled steel strip because the above described conventional annealing conditions can be easily achieved by the use of a batch type annealing furnace. Although batch annealing has been considered to be most suited for obtaining excellent workability of steel strip, it has a critical disadvantage that it takes a long period of time to complete the treatment, and hence considerably lowers the production efficiency.

Therefore, considerable effort has been made to develop new processes such as continuous annealing, for producing cold rolled steel strip having excellent workability by a short-time treatment, and in recent years some continuous annealing processes have been disclosed, for example, in Japanese Patent Publication Sho 42-11911, Japanese Laid-open Patent Applications Sho 50-72816, Sho 50-125918 and Sho 51-32418.

However, it has never been understood that these prior art processes have certain defects as discussed below.

In the conventional continuous annealing process, the main consideration has been to achieve a satisfactorily large grain size, and it has been considered that a longer holding time produces better grain size characteristics. This is in spite of the fact that continuous annealing was developed for the purpose of shortening the treating time. This is clearly illustrated in the above-mentioned prior art publications in which only the lower limits of the annealing time are defined.

Indeed, a longer annealing time promotes full growth of grains so that a large grain size can be obtained, and this does have certain advantages. However, if the annealing time is excessively long, the carbides which have been precipitated in the hot rolled steel strip will be dissolved during the annealing process, thereby increasing the amount of solute carbon, and thus causing deterioration of the workability of the cold rolled steel strip. To avoid this drawback, in the conventional continuous annealing process, the cold rolled steel strip, after annealing, is subjected to an over-ageing treatment at about 400° C. for a considerably long period of time so as to precipitate the solute carbon again as carbides.

Thus, the conventional continuous annealing processes include the following contradictory considerations:

(a) a longer annealing time produces a larger grain size, thus improving the workability of cold rolled steel;

(b) a shorter annealing time is more effective in preventing dissolving of carbides formed in the hot rolled steel strip, thus shortening the subsequent over-ageing treatment.

However, only the factor (a) has been taken into consideration in the conventional processes, and no consideration has been given to the factor (b).

SUMMARY OF THE INVENTION

One of the objects of the present invention is to provide a novel, short-time continuous annealing process which has been developed by taking the aforementioned factors into consideration and which improves the deep-drawability, in particular as represented by the $\bar{r}$ value, of thus produced cold rolled steel strip.

The short-time continuous annealing process according to the present invention comprises:

rapidly heating a low carbon steel strip produced by hot rolling followed by cold rolling to a recrystallization temperature range at a heating rate not less than 40° C./second, slowly heating the thus rapidly heated steel strip to an annealing temperature at a heating rate ranging from 5° to 30° C./second, annealing the thus slowly heated steel strip at an annealing temperature T which is no lower than 700° C. and no higher than the $A_3$ transformation temperature and for an annealing time t no shorter than $[8-0.03\ (T-680)]$ seconds and no longer than $[80-0.15\ (T-680)]$ seconds, initially slowly cooling the thus annealed steel strip at a cooling rate less than 50° C. second, and then rapidly cooling the strip at a cooling rate not less than 50° C./second from a temperature $T_Q$ ranging from higher than 600° C. to no higher than $[T-0.027\ (T-680)\ (\sqrt{t}+23.7)]$°C. to an over-ageing temperature range, and subjecting the thus cooled steel strip to an over-ageing treatment at a temperature ranging from 300° to 500° C. for a period of time ranging from 10 seconds to 5 minutes.

BRIEF DESCRIPTION OF THE DRAWINGS

The present invention will be more clearly understood from the following description taken together with the attached drawings, in which.

DETAILED DESCRIPTION OF THE INVENTION

Figure 1:
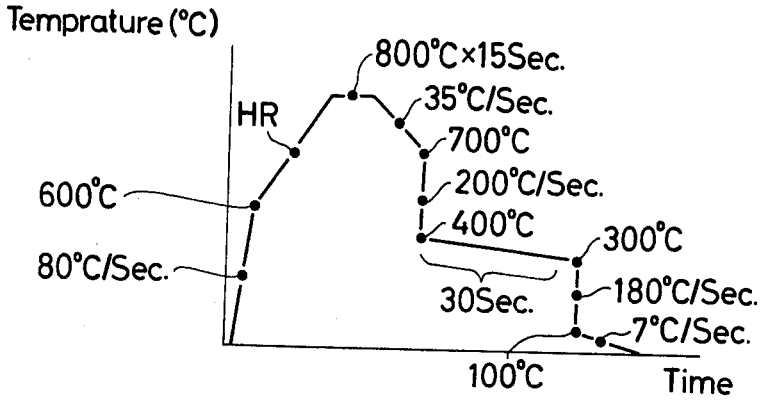
FIG. 1 is a diagram of the continuous annealing cycle according to one embodiment of the invention.

Steel strip formed from low carbon steel which has been hot rolled and then cold rolled contains a considerable amount of strain, and when such steel strip is heated to the recrystallization temperatures for the steel or higher new grains free from strain are formed.

According to results of extensive studies conducted by the present inventors, if the steel strip is rapidly heated to the recrystallization temperature range, i.e. the recrystallization temperature ±50° C., so as to produce recrystallized grains rapidly while retaining the strain caused by the cold rolling, and then the steel strip is heated slowly, the grains grow explosively, during which the amount of growth of the {111} orientation component increases, thus improving the $\bar{r}$ value of the resultant products.

The essential conditions for markedly developing the above effects are:

that the steel strip be rapidly heated to the recrystallization temperature range, i.e. the recrystallization temperature ±50° C. at a heating rate not less than 40° C. second;

below this heating rate, satisfactory retention of the cold rolling strain does not occur;

that the steel strip then be slowly heated from above the recrystallization temperature range to the annealing temperature at a heating rate ranging from 5° to 30° C./second for obtaining an explosive grain growth;

a heating rate exceeding 30° C./second does not provide enough time for the grain growth, while a heating rate below 5° C./second requires too long a time for the heating and causes dissolving of a large amount of the carbides which have been precipitated in the hot rolled steel strip.

For obtaining grains which are large enough and desirable for improved workability, it is necessary that the annealing temperature T (°C.) be no lower than 700° C. but if the annealing temperature is higher than the $A_3$ transformation temperature, the {111} component tends to decrease due to transformation during the annealing. Therefore, it is desirable that the annealing temperature T be in the range from 700° C. to the $A_3$ transformation temperature.

Further for promoting full growth of the grains the annealing time t (seconds) should be shorter the higher the annealing temperature T. For steels having a carbon content of 0.003 to 0.04%, the critical range has been found to be:

$t \geqq [8-0.03\ (T-680)]$ and for steels having a carbon content of 0.04 to 0.08%, the lower limit has been found to be:

$[20-0.03\ (T-680)]$

If the annealing time t is shorter than these times full grain growth cannot be achieved. On the other hand, if the annealing time t is too long, the dissolving of carbides becomes too great as described hereinbefore. Thus for steels with a carbon content of 0.003 to 0.04% the upper limit of the annealing time t should be:

$t \leqq [40-0.15\ (T-680)]$ and for steels having a carbon content of 0.04 to 0.08%, the upper limit has been found to be:

$[80-0.15\ (T-680)]$

A higher annealing temperature T will promote the dissolving of the carbides, and therefore, the annealing time t should not exceed these times. In this case, if the annealing temperature T gets above the $A_3$ transformation temperature, the dissolving of carbides progresses rapidly. For this reason alone, the annealing temperature T should be below the $A_3$ transformation temperature.

When annealing is performed under these conditions, it is possible to obtain satisfactorily large grains and a high r value while minimizing the dissolving of carbides during the annealing process.

It should be noted, however, that a very small amount of solute carbon can be present in the hot rolled steel strip and dissolving of a small amount of carbides is unavoidable during the annealing process. Therefore, consideration must be given to precipitation of these types of solute carbons.

For precipitation of the solute carbon as carbides, it is desirable that a relatively slow cooling be effected in the initial stage of cooling following the annealing so as to keep the steel strip in the higher temperature zone the longest time possible, because the diffusion of carbon preceeds at a constant speed and proceeds more rapidly at a higher temperature. For this purpose, the initial cooling rate after annealing is preferably not greater than 50° C./second.

A higher cooling rate cannot provide enough time for full precipitation of carbon.

On the other hand, it is not advantageous to continue such a slow cooling down to low temperatures because this increases the time required for the overall process. Therefore it is recommended that the slow cooling be terminated after an appropriate period of time.

The establishment of the appropriate time for termination of the slow cooling is one of the important aspects of the present invention.

If the time of termination of the slow cooling is designated $T_Q$ (°C.), it is necessary to provide a long period of time for the slow cooling (i.e. to increase the time for passing through the temperature range ($T-T_Q$)) when a larger amount of carbides has been dissolved in the steel during the annealing (hence increase in the amount of solute carbon), and the increase in the amount of solute carbon during the annealing becomes larger as the value of $\sqrt{t}$ increases. Therefore, an appropriate range for $T_Q$ is higher than 600° C. but not higher than $[T-0.027\ (T-680)\ (\sqrt{t}+23.7)]$°C. Even if $T_Q$ is set at 600° C. or lower, the diffusion rate of carbon is greatly retarded at 600° C. or lower so that only a slight promotion of carbon precipitation can be achieved below 600° C. On the other hand, if $T_Q$ is above $[T-0.027\ (T-680)\ (\sqrt{t}+23.7)]$°C., no efficient carbon precipitation can be effected because of the high temperature.

At the point where the annealed strip has been cooled to 600° C., most of the solute carbon has been converted into precipitates, and the amount of solute carbon remaining decreases to a very small amount. Nevertheless it is important to further precipitate the small amount of solute carbon remaining for further improvement of the workability of the resultant product. However, at a temperature of 600° C. or lower, the diffusion rate of carbon is retarded so that the carbide precipitation is slowed considerably.

Therefore, in the present invention, the degree of super-saturation of carbon is increased by rapid cooling from the temperature $T_Q$ so as to promote the carbide precipitation. Thus, the steel strip is rapidly cooled from the temperature $T_Q$ to the over-ageing temperature range at a cooling rate not less than 50° C./second.

It should be noted that when the steel strip is annealed and cooled to the temperature $T_Q$ under the conditions as defined hereinbefore, and then slowly cooled from the temperature $T_Q$ at a cooling rate less than 50° C./second, the degree of super-saturation of carbon cannot be sufficiently increased. On the other hand, when the steel strip is rapidly cooled to a temperature lower than the over-ageing temperature range, the degree of super-saturation of carbon becomes very high and the carbides are so finely and closely dispersed that precipitation hardening is caused. This produces disadvantages such that reheating is required for over-ageing, thus consuming additional energy. When the dissolving of carbide during the annealing process is inhibited, and the degree of carbon super-saturation is enhanced, it is possible to markedly shorten the time required for the over-ageing treatment. Thus for steels with a carbon content of 0.003 to 0.04% a minimum of 10 seconds can be enough for the over-ageing treatment, and an over-ageing time exceeding 2 minutes will not provide any additional effect. For steels with a carbon content of 0.04 to 0.08% a minimum of 2 minutes can be sufficient and a maximum exceeding 5 minutes will not provide any additional effect.

According to the present invention, the over-ageing temperature is defined in the range from 300° to 500° C. Below 300° C., the diffusion rate of carbon is further retarded so that an over-ageing treatment of about 10 seconds will not produce any effect, and above 500° C., on the other hand, it is not possible to reduce the amount of solute carbon regardless of how much the over-ageing time is increased because the limit of dissolved carbon is so high.

The desired results of the present invention can be obtained even if the steel strip is subjected to a surface treatment, such as electrolyte or molten metal galvanizing, phosphate treatment or pre-treatment, electrolytic or alkaline cleaning, oxidation or acid pickling, and treatment by chemical agents, before, during or after the continuous annealing process, or even if the steel strip is subjected to temper rolling and slight plastic deformation for shape correction after the continuous annealing process.

The preferred conditions for practicing the present invention are set forth below.

(1) The present invention is preferably applied to steels containing 0.003 to 0.08% carbon, because when the present invention is applied to steels containing less than 0.003% carbon only a slight improvement of the properties can be obtained due to the low level of carbon, and when the present invention is applied to steels containing more than 0.08% carbon, the workability of the resultant product is reduced by the carbon content.

(2) In order to permit full grain growth in the hot rolled steel strip and to promote full precipitation of carbides so as to obtain soft final products, it is preferable that the slab heating for the hot rolling is maintained in a range of from 950° to 1200° C., that the hot rolled steel strip be finished in a temperature range of from 680° to 950° C. and coiled at a temperature not higher than 760° C.

(3) If the initial cooling rate after the annealing is too high, the grains will be finely divided due to the $\gamma$ to $\alpha$ transformation, thus causing reduced $\bar{r}$ values. Therefore, it is particularly desirable that the initial cooling rate after the annealing be maintained at less than 35° C./second.

(4) In order to maintain a high degree of super-saturation of the carbon so as to improve the efficiency of the over-ageing treatment, it is desirable that the temperature $T_Q$ be in a range of from a temperature 30 degrees lower than the upper limit to the upper limit temperature.

(5) Also in order to maintain a high degree of super-saturation of the carbon so as to improve the efficiency of the over-ageing treatment, and further to prevent deformation of the steel strip due to thermal strain in the steel strip due to the rapid cooling, it is desirable that the cooling rate from the temperature $T_Q$ be in the range of from 50° C./second to 650° C./second, and more preferably in the range of from 80° C./second to 650° C./second.

(6) In order to prevent excessive super-saturation of carbon, and thereby prevent the finely divided and close precipitations of carbides during the over-ageing treatment, it is desirable that the initial temperature of the over-ageing treatment be identical to the final temperature of the rapid cooling from the temperature $T_Q$. However, if the final target temperature of the rapid cooling is overshot and the actual final temperature is lower than the initial temperature of the over-ageing treatment, the temperature difference should preferably not be larger than 50 degrees. This avoids causing the grains of carbide becoming too fine, and also the time for reheating to the over-ageing temperature is negligible relative to the total overageing time.

(7) If the temperature is slowly raised during the over-ageing treatment, the carbides are dissolved. Therefore, it is desirable to maintain the temperature constant during the treatment, or to lower the temperature slowly or stepwisely, or to combine these procedures, so as to maintain the final temperature of the over-ageing treatment in a range of from 300° to 400° C.

(8) In order to promote the grain growth during the heating and holding steps in the annealing process, it is desirable to strain the steel strip intermittently 0.1% to 5%, and preferably no more than 3%, and for preventing the finely divided carbide precipitation during the over-ageing treatment it is desirable to maintain the strain given to the steel strip during the over-ageing treatment at an amount not larger than 1.2%.

(9) For the purpose of softening the product by utilizing the carbon precipitation during the cooling to a temperature near the room temperature after the over-ageing treatment, it is desirable, after the over-ageing treatment, to cool the steel strip to a temperature near the room temperature at a cooling rate not higher than 30° C./second.

(10) For steels containing solute or dissolved nitrogen, it is desirable to cool the steel strip rapidly after the over-ageing treatment to a temperature no higher than 100° C. at a cooling rate not less than 30° C./second, and then to slowly cool the sheet to a temperature near the room temperature at a cooling rate no higher than 10° C./second.

(11) In order to prevent strain ageing hardening during or immediately after the temper rolling, it is desirable to cool the steel strip to a temperature no higher than 45° C. before the temper rolling or shape correction.

EXAMPLE 1

Al-killed steel containing 0.018% carbon and 0.23% manganese was prepared in a converter and made into slabs by continuous casting. The slabs were hot rolled to strips with a thickness of 2.8 mm and coiled under the following condition:

| | |
|---|---|
| Heating temperature: | 1080° C. |
| Finishing temperature: | 890° C. |
| Coiling temperature: | 650° C. |

After acid pickling, the hot rolled strips were cold rolled into 0.8 mm thick cold rolled strips. The cold rolled strips thus obtained were subjected to the continuous annealing cycle as illustrated in FIG. 1.

The heating rate (HR) of the slow heating from 600° C., which was within the recrystallization temperature range (the recrystallization temperature of the samples used in this example was 585° C.) to 800° C. was varied from 1° to 120° C./second, and tension test pieces (in accordance with JIS B7702 No. 5) were prepared from the steel strips and tested to determine their rupture elongation and average $\bar{r}$ value in three directions, namely L, C, and D.

Figure 2:
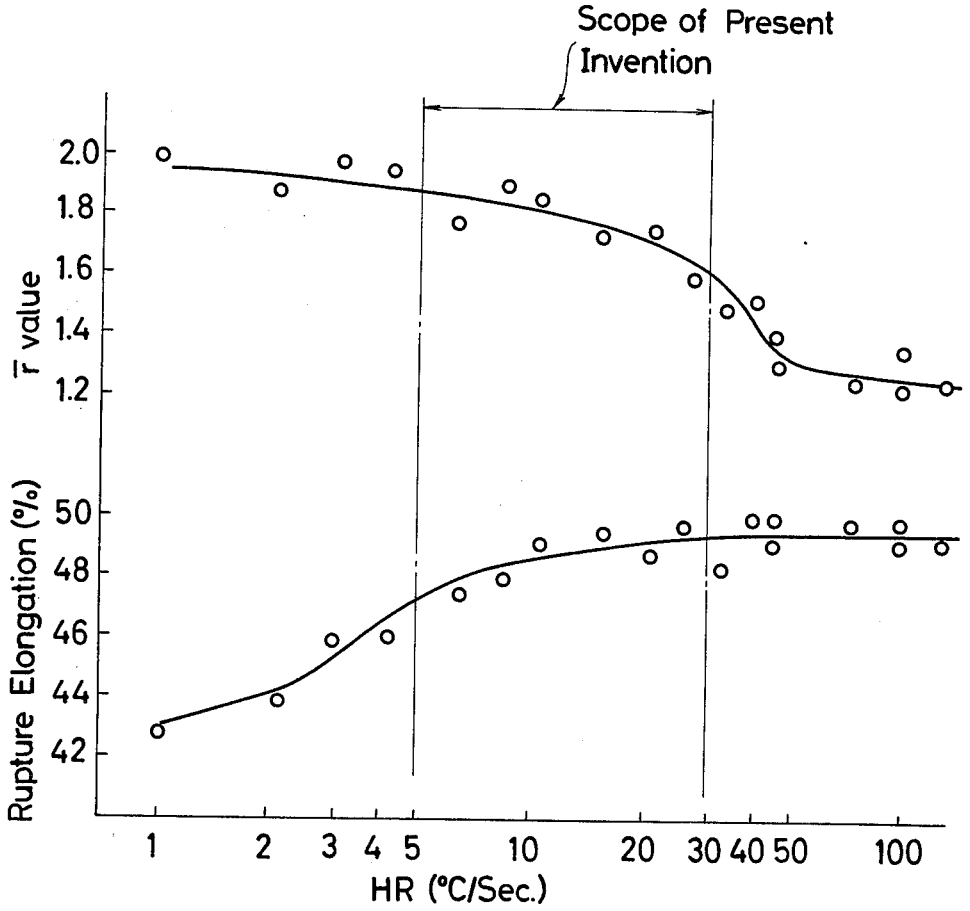
FIG. 2 is a graph showing the influence of the heating rate up to the annealing temperature on the rupture elongation and the r value of the steel strip treated according to the embodiment of FIG. 1.

The results are shown in FIG. 2. When the heating rate (HR) is within the range of from 5° to 30° C./second, which is the range according to the present invention, both the resultant rupture elongation values and also the resultant $\bar{r}$ values are very high, thus showing that a cold rolled steel strip having excellent deep-drawability can be obtained by the process according to the present invention.

EXAMPLE 2

Al-killed steel containing 0.021% carbon and 0.18% manganese was prepared in a converter and made into slabs by continuous casting. The slabs were hot rolled to strips with a thickness of 3.2 mm and coiled under the following conditions:

| | |
|---|---|
| Heating temperature: | 1050° C. |
| Finishing temperature: | 880° C. |
| Coiling temperature: | 700° C. |

Figure 3:
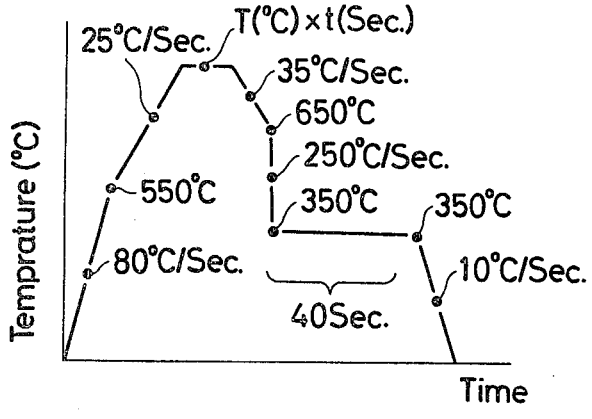
FIG. 3 is a diagram of the continuous annealing cycle according to another embodiment of the invention.

After acid pickling, the hot rolled strips were cold rolled into 1.0 mm thick cold rolled strips. The $A_3$ transformation temperature of these cold rolled strips was 875° C. These strips were subjected to the continuous annealing cycle as illustrated in FIG. 3.

The annealing temperature T was varied from 650° to 1000° C. and the annealing time t was varied from 0 to 60 seconds to provide various combinations of T and t.

After the annealing, the cold rolled strips were given an 0.8% temper rolling, and tension test pieces (JIS B7702 No. 5) were prepared therefrom and their rupture elongation evaluated.

Figure 4:
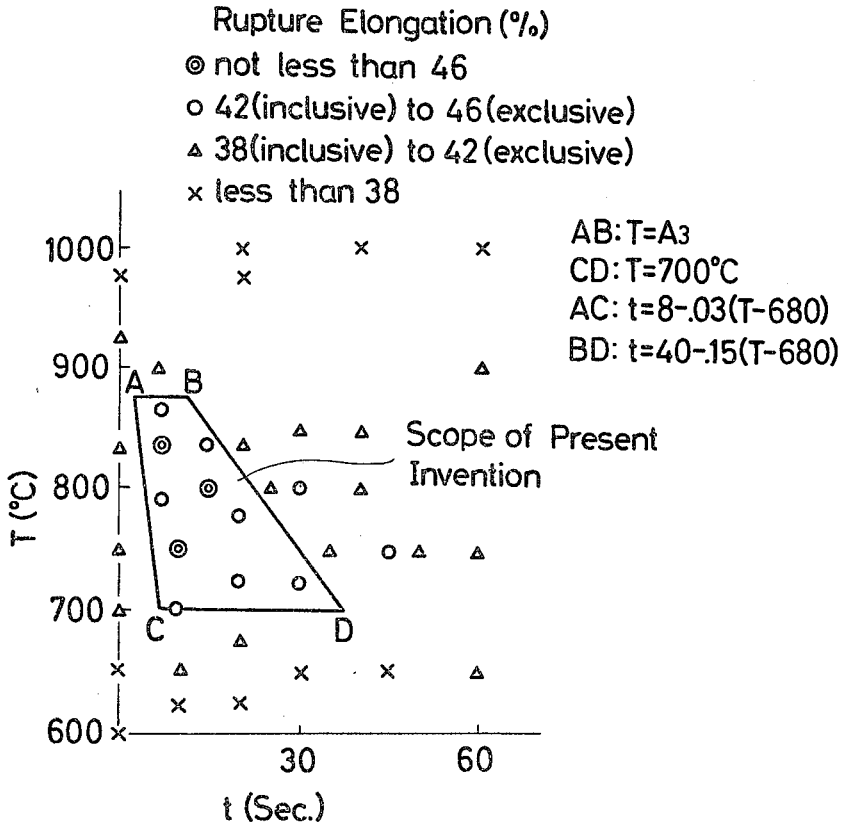
FIG. 4 is a graph showing the relation between the annealing temperatures (T) and the annealing times (t) and the rupture elongation of the steel strip treated according to the embodiment of FIG. 2.

The results are shown in FIG. 4, from which it is clear that a high level of rupture elongation can be obtained under the annealing conditions as defined by the present invention. The recrystallization temperature of the strip used in this example was 560° C.

EXAMPLE 3

Figure 5:
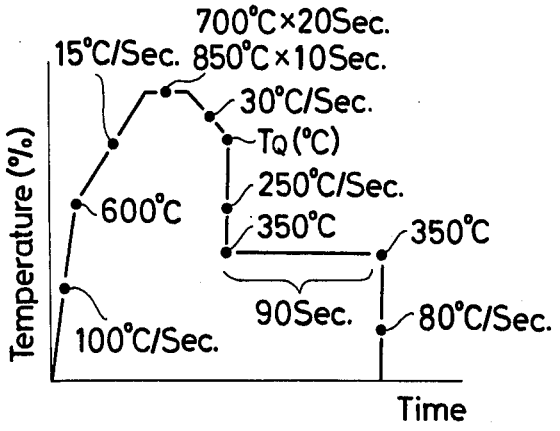
FIG. 5 is a diagram of the continuous annealing cycle according to a still further embodiment of the invention.

The same cold rolled strips as in Example 2 were subjected to the continuous annealing cycle as illustrated in FIG. 5 at 700° C. for 20 seconds and 850° C. for 10 seconds, while the terminal temperature of the slow cooling $T_Q$ was varied from 500° to 800° C.

Figure 6:
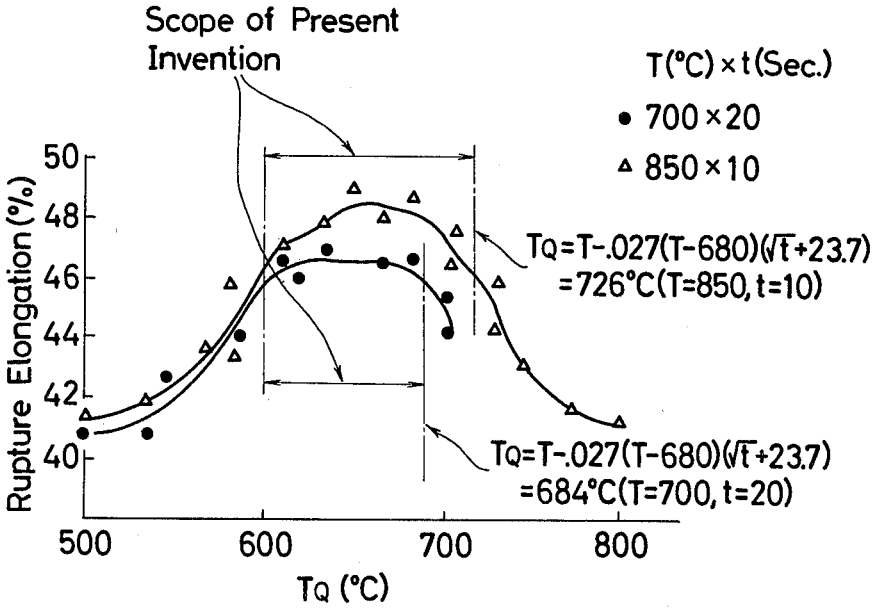
FIG. 6 is a graph showing the influence of the termination temperature ($T_Q$) of slow cooling on the rupture elongation of the steel strip treated according to the embodiment of FIG. 5.

The rupture elongation was evaluated the same way as in Example 2. The results are shown in FIG. 6, from which it is clear a high level of rupture elongation can be obtained by the present invention.

EXAMPLE 4

A capped steel containing 0.056% carbon and 0.25% manganese was prepared in a converter, made into slabs by an ingot making process, and hot rolled to a thickness of 2.8 mm under the following conditions:

| | |
|---|---|
| Heating temperature: | 1200° C. |
| Finishing hot rolling: | 890° C. |
| Coiling temperature: | 670° C. |

After acid pickling, the hot rolled steel strip was cold rolled to a thickness of 0.8 mm and samples were taken therefrom. The A3 transformation temperature of the samples was 850° C.

The samples were subjected to the continuous annealing cycle as shown in FIG. 3, the annealing temperature T being varied from 550° to 900° C. and the annealing time t varied from 10 to 120 seconds. The over-ageing time was 120 seconds. Testpieces according to JIS B7702 NR.5 were prepared and subjected to tension tests to determine the rupture elongation and the average $\bar{r}$ value. The results revealed that the rupture elongation and the average $\bar{r}$ value varied depending on the annealing temperature T and time t and that a rupture elongation not less than 44% at an $\bar{r}$ value not less than 1.40 can be obtained when the temperature T is from 700 to 830 and time t is from $[20-0.03\ (T-680)]$ to $[80-0.15\ (T-680)]$.

EXAMPLE 5

Samples the same as those in example 4 were subjected to the annealing cycle as shown in FIG. 3 at 730° C. for 40 seconds and the over-ageing treatment was at 350° C. with the time being varied from 10 to 300 seconds to determine the effect on rupture elongation and average $\bar{r}$ value. The results revealed that both the rupture strength and the average $\bar{r}$ value improve as the over-ageing time increases and an over-ageing treatment for 120 seconds produced a 44.5% rupture elongation and 1.45 average $\bar{r}$ value. When the over-ageing time exceeded 120 seconds, the rupture elongation and the average $\bar{r}$ value gradually improved, but almost saturated at about 300 seconds.

What is claimed is:

1. A process for producing a cold rolled steel strip having excellent deep drawing properties by a short-time continuous annealing, which comprises:

hot rolling a low carbon steel slab of steel having a carbon content of from about 0.003 to 0.08% into a steel strip;

cold rolling the hot rolled steel strip;

rapidly heating the cold rolled steel strip to a recrystallization temperature range at a heating rate not less than 40° C./second;

slowly heating the thus rapidly heated steel strip to an annealing temperature at a heating rate ranging from 5° to 30° C./second;

annealing the thus slowly heated steel strip at an annealing temperature T which is no lower than 700° C. and no higher than the $A_3$ transformation temperature and for an annealing time t no shorter than $[8-0.03\ (T-680)]$ seconds and no longer than $[80-0.15\ (T-680)]$ seconds;

initially slowly cooling the thus annealed steel strip at a cooling rate less than 50° C. second, and then rapidly cooling the strip at a cooling rate not less than 50° C./second from a temperature $T_Q$ ranging from higher than 600° C. to no higher than $[T-0.027\ (T-680)\ (\sqrt{t}+23.7)]$°C. to an over-ageing temperature range; and subjecting the thus cooled steel strip to an over-ageing treatment at a temperature ranging from 300° to 500° C. for a period of time ranging from 10 seconds to 5 minutes.

2. A process as claimed in claim 1 in which the step of hot rolling comprises hot rolling a low carbon steel slab of a steel having a carbon content of from about 0.003 to 0.04%, and the step of annealing is for an annealing time t no longer than $[40-0.15\ (T-680)]$ seconds.

3. A process as claimed in claim 1 in which the step of hot rolling comprises hot rolling a low carbon steel slab of a steel having a carbon content of from about 0.04 to 0.08%, and the step of annealing is for an annealing time no shorter than $[20-0.03\ (T-680)]$ seconds.

4. A process according to claim 2 or 3 in which the hot rolling comprises hot rolling the slab at a slab heating temperature ranging from 950° to 1200° C., finishing the hot rolled steel at a finishing temperature ranging from 680° to 950° C., and coiling it at a coiling temperature not higher than 760° C.

5. A process according to claim 2 or 3 in which the initial cooling rate after the annealing is less than 35° C./second.

6. A process according to claim 2 or 3 in which the temperature range $T_Q$ is within 30 degrees below the upper limit $[T-0.027\ (T-680)\ (\sqrt{t}+23.7)]$°C.

7. A process according to claim 2 or 3 in which the cooling rate from the temperature range $T_Q$ is from 50° C./second to 650° C./second.

8. A process according to claim 2 or 3 in which the rapid cooling from the temperature range $T_Q$ ends at the initial temperature of the over-ageing treatment.

9. A process according to claim 2 or 3 in which the rapid cooling from the temperature range $T_Q$ ends at a temperature not more than 50 degrees lower than the initial temperature of the over-ageing treatment.

10. A process according to claim 2 or 3 in which the over-ageing treatment is carried out in a temperature range of from 300° to 400° C.

11. A process according to claim 2 or 3 further comprising giving the steel strip not less than 0.1% strain during the annealing, and not more than 1.2% strain during the over-ageing treatment.

12. A process according to claim 2 or 3 further comprising cooling the steel strip, after the over-ageing treatment, to a temperature near room temperature at a cooling rate not greater than 30° C./second.

13. A process according to claim 2 or 3 in which the steel contains dissolved nitrogen, and said process further comprises rapidly cooling the steel strip, after the over-ageing treatment, to a temperature no higher than 100° C. at a cooling rate not less than 30° C./second and then slowly cooling the steel strip to a temperature near room temperature at a cooling rate not greater than 10° C./second.

* * * * *